US008847075B2

(12) United States Patent
Ikeda et al.

(10) Patent No.: US 8,847,075 B2
(45) Date of Patent: Sep. 30, 2014

(54) INSULATED WIRE

(75) Inventors: Keisuke Ikeda, Tokyo (JP); Makoto Oya, Tokyo (JP); Yoshihisa Kano, Tokyo (JP); Takashi Aoki, Toyoake (JP); Tatsunori Makishima, Okazaki (JP); Akio Sugiura, Kariya (JP); Hiromitsu Asai, Nagoya (JP); Shinichi Matsubara, Anjyo (JP)

(73) Assignees: Furukawa Electric Co., Ltd., Tokyo (JP); Furukawa Magnet Wire Co., Ltd., Tokyo (JP); Denso Corporation, Kariya-shi, Aichi (JP)

( * ) Notice: Subject to any disclaimer, the term of this patent is extended or adjusted under 35 U.S.C. 154(b) by 261 days.

(21) Appl. No.: 13/556,936

(22) Filed: Jul. 24, 2012

(65) Prior Publication Data

US 2013/0037304 A1 Feb. 14, 2013

(30) Foreign Application Priority Data

Aug. 12, 2011 (JP) ..... 2011-176496

(51) Int. Cl.

| | |
|---|---|
| ***H01B 3/30*** | (2006.01) |
| ***H01B 7/00*** | (2006.01) |
| *H01B 7/02* | (2006.01) |

(52) U.S. Cl.

CPC ..... *H01B 3/30* (2013.01); *H01B 7/0216* (2013.01)

USPC ..... 174/119 C; 174/110 N

(58) Field of Classification Search

CPC ..... H01B 3/00; H01B 7/00

USPC ..... 174/119 C, 110 N

See application file for complete search history.

(56) References Cited

U.S. PATENT DOCUMENTS

| | | | |
|---|---|---|---|
| 6,388,195 | B1 | 5/2002 | Studer et al. |
| 2006/0194051 | A1 | 8/2006 | Fukuda et al. |
| 2009/0202831 | A1 | 8/2009 | Honda et al. |

FOREIGN PATENT DOCUMENTS

| | | | |
|---|---|---|---|
| JP | 51-63984 | U | 5/1976 |
| JP | 58-37617 | U | 3/1983 |
| JP | 59-40409 | A | 3/1984 |
| JP | 63-195913 | A | 8/1988 |
| JP | 2000-331540 | A | 11/2000 |
| JP | 2005-203334 | A | 7/2005 |
| JP | 2007-100079 | A | 4/2007 |
| JP | 4177295 | B2 | 11/2008 |
| JP | 2009-218201 | A | 9/2009 |
| JP | 2010-170910 | A | 8/2010 |
| WO | WO 2005/106898 | A1 | 11/2005 |

OTHER PUBLICATIONS

Decision to Grant a Patent for Japanese Application No. 2011-176496 dated Dec. 10, 2013, with English translation.

*Primary Examiner* — Timothy Thompson
*Assistant Examiner* — Charles Pizzuto
(74) *Attorney, Agent, or Firm* — Birch, Stewart, Kolasch & Birch, LLP

(57) ABSTRACT

An insulated wire having:

a conductor, a baked enamel layer containing at least a polyamide-imide provided on the outer periphery of the conductor directly or through an insulated layer, and at least one extrusion-coated resin layer provided on the outer side of the baked enamel layer, wherein the baked enamel layer has at least one functional group selected from the group consisting of a carboxyl group, an ester group, an ether group and a hydroxyl group on the outer surface thereof, and adheres to the extrusion-coated resin layer.

5 Claims, 3 Drawing Sheets

INSULATED WIRE

FIELD OF THE INVENTION

The present invention relates to an insulated wire.

BACKGROUND OF THE INVENTION

Inverters have been employed in many types of electrical equipments, as an efficient variable-speed control unit. Inverters are switched at a frequency of several kHz to tens of kHz, to cause a surge voltage at every pulse thereof. Inverter surge is a phenomenon in which reflection occurs at a break-point of impedance, for example, at a starting end, a termination end, or the like of a connected wire in the propagation system, followed by applying a voltage twice as high as the inverter output voltage at the maximum. In particular, an output pulse occurred due to a high-speed switching device, such as an IGBT (Insulated Gate Bipolar Transistor), is high in steep voltage rise. Accordingly, even if a connection cable is short, the surge voltage is high, and voltage decay due to the connection cable is also low. As a result, a voltage almost twice as high as the inverter output voltage occurs.

As coils for electrical equipments, such as inverter-related equipments, for example, high-speed switching devices, inverter motors, and transformers, insulated wires made of enameled wires are mainly used as magnet wires in the coils. Further, as described above, since a voltage almost twice as high as the inverter output voltage is applied in inverter-related equipments, it is required in insulated wires to have minimized partial discharge deterioration, which is attributable to inverter surge.

In general, partial discharge deterioration is a phenomenon in which an electrical-insulation material undergoes, in a complicated manner, for example, molecular chain breakage deterioration caused by collision with charged particles that have been generated by partial discharge of the insulating material, sputtering deterioration, thermal fusion or thermal decomposition deterioration caused by local temperature rise, and chemical deterioration caused by ozone generated due to discharge. For this reason, reduction in thickness, for example, is observed in the actual electrical-insulation materials, which have been deteriorated as a result of partial discharge.

It has been believed that inverter surge deterioration of an insulated wire also proceeds by the same mechanism as in the case of general partial discharge deterioration. Namely, inverter surge deterioration of an enameled wire is a phenomenon in which partial discharge occurs in the insulated wire due to the surge voltage with a high peak value, which is occurred at the inverter, and the coating of the insulated wire causes partial discharge deterioration as a result of the partial discharge; in other words, the inverter surge deterioration of an enameled wire is high-frequency partial discharge deterioration.

In order to prevent the deterioration of insulated wires caused by such partial discharge, investigations have been conducted on an insulated wire having a high voltage at which partial discharge occurs. In order to obtain this insulated wire, a method of increasing the thickness of the insulating layer of the insulated wire can be considered.

Japanese Patent No. 4177295 discloses an insulated wire in which an adhesive layer is provided between a baked enamel layer and an extrusion-coated resin layer, and the adhesive strength between the baked enamel layer and the extrusion-coated resin layer is strengthened by using the adhesive layer as a medium. When this technique is used, since the solvent resistance of the adhesive layer is lower as compared to other enamel resins, the mechanical characteristics after solvent impregnation are reduced to a large extent.

Further, attempts have been made hitherto to impart added values in terms of properties (properties other than the partial discharge-occurring voltage) to the enameled wire by providing a resin coating at the outer surface of the enameled wire. For example, JP-A-59-040409 ("JP-A" means unexamined published Japanese patent application), JP-A-63-195913 and the like are mentioned as techniques of the related art in terms of the constitution of providing an extrusion-coated resin layer on an enamel layer. However, these techniques were not so satisfactory in terms of the constitution of the thickness of the enamel layer or the extruded coating, from the standpoint of balancing between the partial discharge-occurring voltage and the adhesiveness between the conductor and the enamel layer.

SUMMARY OF THE INVENTION

The present invention resides in an insulated wire having:

a conductor, a baked enamel layer containing at least a polyamide-imide provided on the outer periphery of the conductor directly or through an insulating layer, and at least one extrusion-coated resin layer provided on the outer side of the baked enamel layer, wherein the baked enamel layer has at least one functional group selected from the group consisting of a carboxyl group, an ester group, an ether group and a hydroxyl group on the outer surface thereof, and adheres to the extrusion-coated resin layer.

Other and further features and advantages of the invention will appear more fully from the following description, appropriately referring to the accompanying drawings.

DETAILED DESCRIPTION OF THE INVENTION

The inventors of the present invention made extensive studies in order to address the problems exhibited by the related art as described above. As a result, the inventors found that when a hydrophilic functional group is provided on the surface of an enamel layer, which is a lower layer film of a thick film-coated wire, an inverter surge resistant insulated wire may be obtained by providing an extrusion-coated resin layer on the outer side of the enamel layer, without providing an adhesive layer having low solvent resistance between the enamel layer and the extrusion-coated resin layer. Further, through this treatment, when the extrusion-coated resin layer is a crystalline thermoplastic resin, adhesive strength is maintained even if the degree of crystallinity is increased. The invention was completed based on these findings.

According to the present invention, there are provided the following means:

(1) An insulated wire having:

a conductor, a baked enamel layer containing at least a polyamide-imide provided on the outer periphery of the conductor directly or through an insulated layer, and at least one extrusion-coated resin layer provided on the outer side of the baked enamel layer, wherein the baked enamel layer has at least one functional group selected from the group consisting of a carboxyl group, an ester group, an ether group and a hydroxyl group on the outer surface thereof, and adheres to the extrusion-coated resin layer.

(2) The insulated wire as described in item (1), wherein the functional group is introduced into the outer surface of the baked enamel layer by plasma-treatment of the baked enamel layer.

(3) The insulated wire as described in item (1) or (2), wherein cross-section shape of the conductor is rectangular.

(4) The insulated wire as described in any one of items (1) to (3), wherein the extrusion-coated resin layer is composed of polyphenylene sulfide.

(5) The insulated wire as described in item (4), wherein the crystallization heat capacity (ΔHc) appearing at the crystallization temperature (Tc) and the melting heat capacity (ΔHm) appearing at the melting point (Tm) in a DSC analysis of the polyphenylene sulfide meet the following formula.

$$0.5 \leq (\Delta Hm - \Delta Hc)/\Delta Hm \leq 1.0$$

Figure 1:
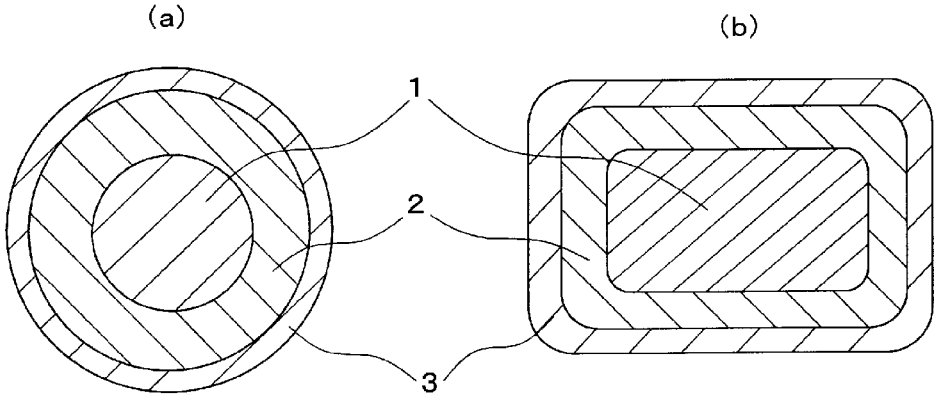
FIG. 1 is a cross-sectional diagram schematically illustrating a preferred embodiment of an insulated wire of the present invention. (a) represents a wire with a conductor having a circular cross-section. (b) represents a wire with a conductor having a rectangular cross-section.

Example of a preferred embodiment of the insulated wire of the present invention is shown in FIG. 1. As a cross-sectional diagram schematically illustrated in FIG. 1, the insulated wire of the present invention has a baked enamel layer 2 provided on a conductor 1 directly or through an insulated layer, and further, at least one extrusion-coated resin layer 3 is coated on the baked enamel layer 2. FIG. 1(*a*) illustrates a wire having a circular cross-section, and FIG. 1(*b*) illustrates a wire having a rectangular cross-section. Hereinafter, the present invention is described in detail.

(Conductor)

As the conductor that can be used in the present invention, any conductor conventionally used in insulated wires may be employed. The conductor that can be used in the present invention is preferably a conductor composed of a low-oxygen copper. Oxygen content of the low-oxygen copper is preferably 30 ppm or less, and more preferably 20 ppm or less. A conductor composed of oxygen-free copper is also preferable. By using these preferred conductors, it may be possible to avoid development of voids at a welded portion, which is derived from oxygen contained in the conductor, and thereby, the deterioration of the electrical resistance of the welded portion can be prevented, and the strength of the welded portion can be maintained.

Further, shape of the cross-section of the conductor is not limited, but it is preferable to use a conductor having a cross-sectional shape except for a circular shape, and particularly preferable to use a conductor having rectangular cross-section. Among the conductors having rectangular cross-section, a conductor having chamfers (radius r) at four corners thereof is preferred, in terms of suppressing partial discharge from corners.

In the case of an inverter surge resistant insulated wire with a conductor having a rectangular-shaped cross-section as illustrated in FIG. 1(*b*), as long as a pair of the facing planes of the extrusion-coated resin layer, where discharge occurs, has a predetermined thickness, even though the thickness of the other pair of facing planes is thinner than the above-mentioned thickness, the partial discharge-occurring voltage can be maintained, and also, the space factor can be increased.

With regard to a preferred dimension of the conductor, when the cross-section of the conductor is circular shape, the diameter of the cross-section is preferably 0.4 mm to 1.2 mm, and when the cross-section of the conductor is rectangular shape, the thickness of the cross-section is preferably 0.5 mm to 2.5 mm, and the width of the cross-section is preferably 1.4 mm to 4.0 mm.

(Baked Enamel Layer)

The baked enamel layer (hereinafter, also referred to as "enamel layer") is formed, by coating a resin varnish (if needed, the resin varnish may contain various additives such as an antioxydant, an antistatic agent, an anti-ultraviolet agent, a light stabilizer, a fluorescent brightening agent, a pigment, a dye, a compatibilizing agent, a lubricating agent, a reinforcing agent, a flame retardant, a crosslinking agent, a crosslinking aid, a plasticizer, a thickening agent, a thinning agent, and an elastomer) onto a conductor several times, and baking the conductor. A method of coating the resin varnish may be a usual manner. For example, a method using a die for coating varnish, which has a shape similar to the shape of a conductor. When the conductor has a quadrangular cross-section, a die called "universal die" that is formed in the shape of a curb. The conductor to which the resin varnish is coated is baked in a baking furnace in a usual manner. Specific baking conditions depend on the shape of the furnace to be used. In the case of using a natural convection-type vertical furnace with length approximately 5 m, baking may be achieved by setting a transit time of 10 to 90 sec at 400 to 500° C.

The enamel layer may be formed on the outer periphery of the conductor through an insulating layer. As the enamel resin that forms the enamel layer, any of those conventionally utilized can be put to use, and examples include polyamide-imide (PAI), polyimide (PI), polyesterimide, polyetherimide, polyimide hydantoin-modified polyester, polyamide, formal, polyurethane, polyester, polyvinylformal, epoxy, and polyhydantoin. Preferred enamel resins are polyimide-based resins, such as polyimide, polyamide-imide, polyesterimide, polyetherimide, and polyimide hydantoin-modified polyester, which are excellent in heat resistance. An ultraviolet-curable resin or the like may also be used.

Further, these may be used singly alone, or may be used as a mixture of two or more kinds thereof. However, according to the present invention, the enamel layer contains at least a polyamide-imide. The content of the polyamide-imide in the enamel layer is preferably 50% to 100%.

In order to reduce the number of transits through the baking furnace to thereby prevent extreme lowering of the adhesive force between the conductor and the enamel layer, the thickness of the enamel layer is preferably 50 μm or less, and more preferably 40 μm or less. Further, in order to prevent deterioration of voltage resistance or heat resistance, which are properties required for the enameled wires as insulated wires, it is preferable that the enamel layer has a certain thickness. The lower limit of the thickness of the enamel layer is not particularly limited, as long as it is a thickness where no pinholes are formed. The lower limit of the thickness of the enamel layer is preferably 3 μm or more, and more preferably 6 μm or more. One or a plurality of enamel layers may be formed.

(Surface Treatment of Enamel Layer)

The enamel layer of the insulated wire of the present invention has a hydrophilic functional group, for example, at least one selected from the group consisting of a carboxyl group, an ester group, an ether group, and a hydroxyl group, on the surface. The introduction of these groups can be carried out by subjecting the enamel layer to, for example, a plasma treatment or a corona treatment. Alternatively, an adhesive polymer may be coated on the enamel layer as a surface treating agent. Further, adhesiveness can be enhanced by a UV treatment.

Adhesive Polymer

In the invention, as the adhesive polymer that can be used as a surface treating agent for introducing a particular functional group to the surface of the enamel layer, an acrylic resin, an epoxy resin or the like can be used. As the acrylic resin, an aminoethylated acrylic polymer manufactured by Nippon Shokubai Co., Ltd. (trade name: POLYMENT, NK-350) or the like can be used. As the epoxy resin, an epoxy resin-based adhesive manufactured by Cemedine Co., Ltd. (trade name: HIGH QUICK) or the like can be used. Preferably, the surface treating agent can be mixed with the enamel varnish to prepare coating material for surface treatment. The surface treating agent may be applied as a primer on the surface of the enamel layer.

The adhesive polymer preferably has a main-chain composition or pendant functional groups that are capable of reacting with a complementary functional groups present on the inner surface of the extrusion-coated resin layer. Examples of the complementary functional groups include a hydroxyl group, an amino group, a carboxyl group, or a mercapto group.

The adhesive polymer may be coated so that the thickness thereof is to be preferably 1 μm to 10 μm.

Plasma Treatment

For the plasma treatment for treating the surface of the enamel layer, atmospheric plasma can be used. The atmospheric plasma is discharge-like plasma generated by applying a high frequency electric field to the electrodes in an atmosphere of a gas mixture which composed of helium and oxygen at atmospheric pressure. In the interior of the plasma, charged particles of helium are in an excited state, and they excite the oxygen atoms to neutral radicals having higher reactivity. These neutral radicals cleave the amide bonds of the enamel resin, which is the object to be treated, and resulting functional groups are capable of bonding to the extrusion-coated resin which is for forming an outer layer. Thus, it becomes possible to maintain adhesion between the enamel layer and the extrusion-coated resin layer.

Corona Treatment

In the corona treatment, the enamel layer is irradiated with corona discharge electrons. Radical oxygen and the like generated along with the corona discharge are collide against the surface of the enamel layer, and thereby, polar groups such as hydroxyl group and carbonyl group are generated thereon. As a result, hydrophilicity of the surface of the enamel layer is enhanced, and thereby, adhesiveness thereof is enhanced.

UV Treatment

In the UV treatment, when the enamel layer is irradiated with ultraviolet rays, molecular bonds thereof may be cleaved. By these cleaved molecular bonds and radical oxygen and the like, polar groups such as a hydroxyl group and a carbonyl group can be generated. As a result, hydrophilicity of the surface of the enamel layer is enhanced, and thereby, adhesiveness thereof is enhanced.

Bonding State of Functional Group

Whether particular functional groups on the enamel layer, which is introduced by a surface treatment of the enamel layer, can be confirmed by X-ray photoelectron spectroscopy (XPS) as described in the following Examples, or the like.

Chemical structures having those particular functional groups are exemplified below.

In the case where the baked enamel layer has been provided by preparing an enamel varnish prepared by reacting an isocyanate with an acid anhydride, and coating the vanish followed by baking it, the chemical structure to which the functional group is bonded (substituted) is, for example, an aromatic diisocyanate component. The aromatic diisocyanate thereof may have an oligo(p-phenylene) structure which has benzene rings linked in tandem at their para-position, and examples thereof include p-phenylene diisocyanate, biphenyl-4,4'-diisocyanate, terphenyl-4,4'-diisocyanate, diphenylmethane-4,4'-diisocyanate, diphenylmethane-3,3'-diisocyanate, diphenylmethane-3,4'-diisocyanate, diphenyl ether-4,4'-diisocyanate, benzophenone-4,4'-diisocyanate, diphenylsulfone-4,4'-diisocyanate, tolylene-2,4-diisocyanate, tolylene-2,6-diisocyanate, m-xylene diisocyanate, and p-xylene diisocyanate; and derivatives thereof, which have a skeleton of these diisocyanates as a basic structure, and have substituent(s) such as a halogen atom, an alkyl group and an alkoxy group.

In addition to those, the aromatic diisocyanate of the aromatic diisocyanate component may be naphthalene-1,5-diisocyanate, naphthalene-2,6-diisocyanate, anthracene-1,5-diisocyanate, anthracene-2,6-diisocyanate, anthracene-9,10-diisocyanate, phenanthrene-2,7-diisocyanate, phenanthrene-1,6-diisocyanate, anthraquinone-1,5-diisocyanate, anthraquinone-2,6-diisocyanate, fluorene-1,5-diisocyanate, fluorene-2,6-diisocyanate, carbazole-1,5-diisocyanate, carbazole-2,6-diisocyanate, or benzanilide-4,4'-diisocyanate; or derivatives thereof, which have a skeleton of these diisocyanates as a basic structure, and have substituent(s) such as a halogen atom, an alkyl group and an alkoxy group.

Further, examples of the acid anhydride include trimellitic anhydride, tetracarboxylic acid anhydrides, for example, pyromellitic dianhydride, biphenyltetracarboxylic acid dianhydride, benzophenonetetracarboxylic acid dianhydride, diphenylsulfonetetracarboxylic acid dianhydride.

(Extrusion-Coated Resin Layer)

According to the present invention, in order to obtain an insulated wire, partial discharge-occurring voltage of which is high, at least one extrusion-coated resin layer is provided on the outer side of the baked enamel layer. An advantage of the extrusion coating method is that since it is not necessary for the wire to pass through a baking furnace in the production process, the thickness of the insulated layer can be made large without growing the thickness of the oxide coating layer of the conductor.

Furthermore, when the crystallinity of the resin of the extrusion-coated resin layer is relatively high, in the conventional insulated wires, the adhesive strength is decreased as a result of shrinkage or an increase in the elastic modulus. However, in the present invention, since particular functional groups are introduced into the surface of the enamel layer by a surface treatment thereof, a decrease in the adhesive strength caused by the mechanical stress of the layer due to crystallization can be suppressed.

As the resin that is used in the extrusion-coated resin layer, it is preferable to use a resin excellent in heat resistance. Examples thereof include polytetrafluoroethylene (PTFE), tetrafluoroethylene-hexafluoropropylene copolymer (FEP), tetrafluoroethylene-ethylene copolymer (ETFE), tetrafluoroethylene-perfluoroalkyl vinyl ether copolymer (PFA), polyamide (PA), a polyester (PE), polyethylene terephthalate (PET), polybutylene terephthalate (PBT), thermoplastic polyimide (TPI), polyphenylene sulfide (PPS), and polyether ether ketone (PEEK). As the resin used in the extrusion-coated resin layer, it is preferable to use a crystalline resin in view of enhancing the partial discharge-occurring voltage and solvent resistance.

Particularly, in the present invention, it is preferable to use PPS in the extrusion-coated resin layer.

Furthermore, with regard to the crystallinity of this PPS, with regard to the crystallization heat capacity (ΔHc) appearing at the crystallization temperature (Tc), which is about 120° C., and the melting heat capacity (ΔHm) appearing at the melting point (Tm), which is about 280° C., in a DSC (Differential Scanning Calorimetry) analysis, the value of (ΔHm−ΔHc)/ΔHm is preferably 0.5 to 1.0, and more preferably 0.8 to 1.0. When such PPS is used, a coating layer which is excellent in solvent resistance, slippage, and abrasion resistance and does not easily collapse can be formed.

One thermoplastic resin, or mixture of two or more kinds of thermoplastic resins may be used in the extrusion-coated resin layer.

There are no particular limitations on the thickness of the extruded-coating resin layer, but the thickness is preferably 30 μm to 120 μm.

According to the present invention, various additives such as a crystallization nucleating agent, a crystallization accelerating agent, a foam nucleating agent, an oxidation inhibitor, an antistatic agent, an anti-ultraviolet agent, a light stabilizer, a fluorescent brightening agent, a pigment, a dye, a compatibilizing agent, a lubricating agent, a reinforcing agent, a flame retardant, a crosslinking agent, a crosslinking aid, a plasticizer, a thickening agent, a thinning agent, and an elastomer may be incorporated into the raw materials for forming the extrusion-coated resin layer, to the extent that the characteristics are not affected. Furthermore, a layer formed from a resin containing these additives may be laminated on the resulting insulated wire, or the insulated wire may be coated with a coating material containing these additives.

The present invention is contemplated for providing inverter surge resistant insulated wire excellent in abrasion resistance and solvent resistance. Further, the present invention is contemplated for providing an inverter surge resistant insulated wire, in which thickening of the insulating layer for increasing the partial discharge-occurring voltage can be realized without decreasing the adhesive strength between the conductor and the enamel layer of the insulated wire.

The insulated wire of the present invention is excellent in both the "partial discharge-occurring voltage" and the "adhesive strength of the extrusion-coated resin layer/baked enamel layer", and does not easily undergo a decrease in the mechanical characteristics after solvent impregnation. An enhancement of the adhesive strength between the enamel layer and the extrusion-coated layer can be achieved by generating functional groups containing oxygen on the surface of the baked enamel layer using surface treatment technique such as plasma treatment.

Further, in the case of an inverter surge resistant insulated wire with a conductor having a rectangular cross-section, as long as a pair of the facing planes of extrusion-coated resin layer, where discharge occurs, has a predetermined thickness, even though the thickness of the other pair of facing planes is thinner than the above-mentioned thickness, the partial discharge-occurring voltage can be maintained, and further, the space factor can be increased.

Further, since the inverter surge insulated wire of the present invention has high adhesiveness between the baked enamel layer and the extrusion-coated resin layer, when the extrusion-coating resin is a crystallized resin, the adhesive strength can be maintained even if the degree of crystallinity is high, and thereby, solvent resistance can be further enhanced.

EXAMPLES

The present invention is described in more detail based on examples given below, but the present invention is not limited by the following examples.

Examples 1 to 10 and Comparative Examples 1 to 4

Insulated wires were produced under the conditions shown in Tables 1 to 4, and obtained insulated wires were evaluated.

In the case of using a conductor with circular cross-section, the diameter thereof was 1.0 mm. In the case of using a conductor with rectangular cross-section, the width and thickness thereof were 2.4 mm and 3.2 mm, respectively.

When a mixture of PAI and PI was used in the enamel layer, the mixing ratio of the two resin was set to a mass ratio of 50:50. In the Comparative Examples, an intermediate layer was formed using polyphenylsulfone (PPSU).

[Surface Treatment]

(Plasma Treatment)

For the plasma treatment, an atmospheric plasma treatment apparatus was used. The output power of the plasma generating apparatus was set to 100 W. Furthermore, in the plasma generation, a gas mixture of argon and oxygen was used. The flow rate of argon was set to 2.14 L/min, and the flow rate of oxygen was set to 27 mL/min.

(Corona Treatment)

For the corona treatment apparatus, a high frequency corona discharge apparatus was used (manufactured by Navitas Co., Ltd.; trade name: POLYDYNE 1). The output power was set to 500 W, and the output frequency was set to 20 kHz.

(Coating of Surface Treating Agent)

An acrylic resin or an epoxy resin was coated with a coating thickness of 3 μm.

(UV Treatment)

For the UV treatment, a UV irradiation apparatus was used (manufactured by Sen Lights Corp.; trade name: PHOTO SURFACE PROCESSOR). The irradiation intensity was set to about 9.0 W/cm$^2$ to 10.0 W/cm$^2$.

[Hydrophilic Functional Group]

Introduction of a particular functional group on the surface of the enamel layer by a surface treatment thereof was confirmed as follows.

In an XPS(C1s) analysis, when increases in the moieties C—O, C═O, O—C═O, and the like were observed, the sample was rated as A. In all of Examples 1 to 11, the introduction of hydrophilic functional groups was confirmed.

(XPS)

For the detection of the functional groups generated on the surface, X-ray photoelectron spectroscopy method (XPS) was used. Apparatus for the method, trade name: Refurbished ESCA 5400MC, manufactured by Physical Electronics GmbH, was used. XPS is a surface analysis technique utilizing the phenomenon in which when a solid surface is irradiated with X-rays in a vacuum, electrons (photoelectrons) are released from the various orbits of the atoms of a sample. The kinetic energy of the released photoelectrons corresponds to the bound energy of the various orbits, and is characteristic to the element and the chemical state. By measuring the energy and intensity of the released photoelectrons, identification and quantification of atoms can be carried out. The escape depth of photoelectrons is several nanometers from the surface, and the information on the top surface may be obtained. Detailed analysis conditions employed in the Examples are as follows.

Excited X-ray: Conventional Mg Kα ray (1253.6 eV)
Escape angle: 45°
Wide-scan: 1150-0 eV
Narrow-scan: C1s, N1s, O1s, S2p, Si2p
Analyzed region: ϕ1.1 mm Since the X-ray photoelectron spectroscopic method is an analysis method of performing an energy analysis of photoelectrons that are released from a sample surface as a result of X-ray irradiation, the chemical bonding state of the sample can be analyzed from the peak energy (bonding energy) of the photoelectron spectrum and the spectrum shape (number of photoelectrons) obtainable as a result of the energy analysis. Because the depth from which photoelectrons can escape is in the order of nanometers, it is particularly appropriate for the analysis of the surface of a sample.

Among the atomic data obtainable by the XPS analysis, the data on C1s (carbon) are observed by performing waveform separation of the spectrum (curve fitting). In a conventional polyamide-imide, a peak at 288.4 eV originating from the NC═O bond (imide group and amide group), and a peak at 284.2 eV originating from the C—C/C—H bond, and a peak at 285.6 eV originating from the C—O bond (alcohol ether) appear conspicuously. On the other hand, in the case of an adhesion-improved varnish prepared by using at least a polyamide-imide varnish as a raw material, or in an enamel coating film that has been subjected to a surface treatment, a peak at 287.8 eV originating from the C═O bond (carbonyl group) and a peak at 289.0 eV originating from the OC═O bond (ester group) appear, in addition to the NC═O bond, the C—C bond, the C—H bond, and the C—O bond.

Figure 2:
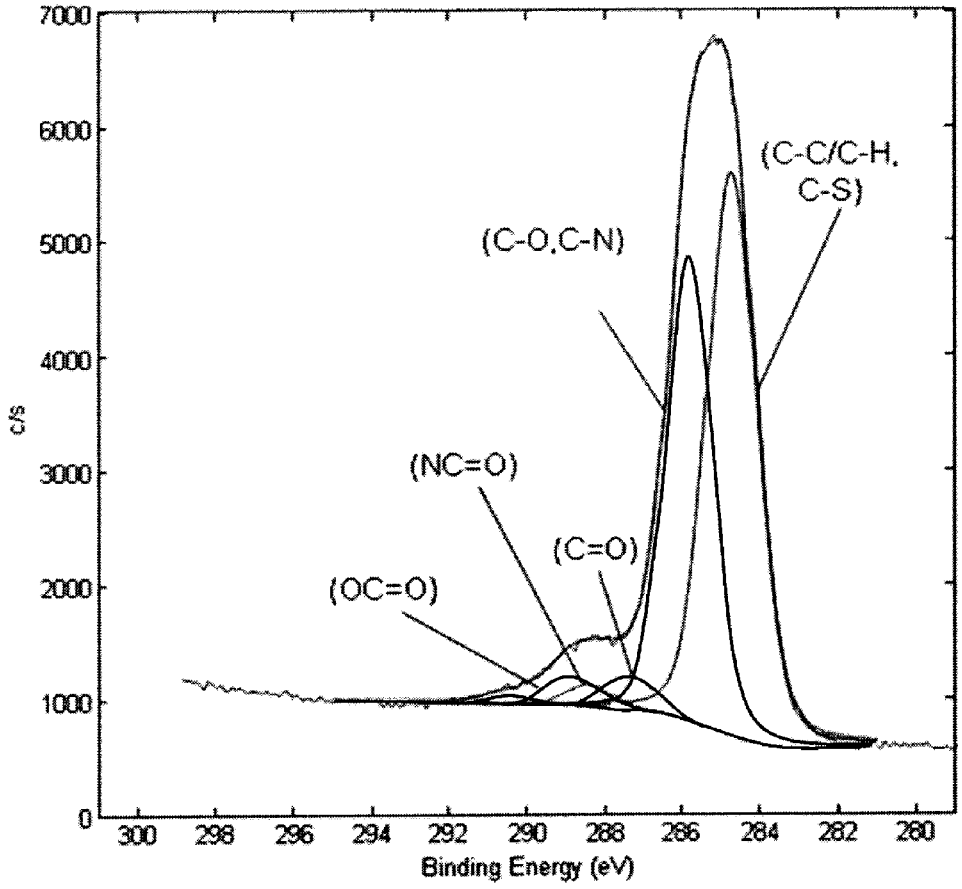
FIG. 2 is a graph showing waveform separation of the spectrum of C1s obtained by XPS analysis of the surface of the enamel layer of the insulated wire described in an example.
Figure 3:
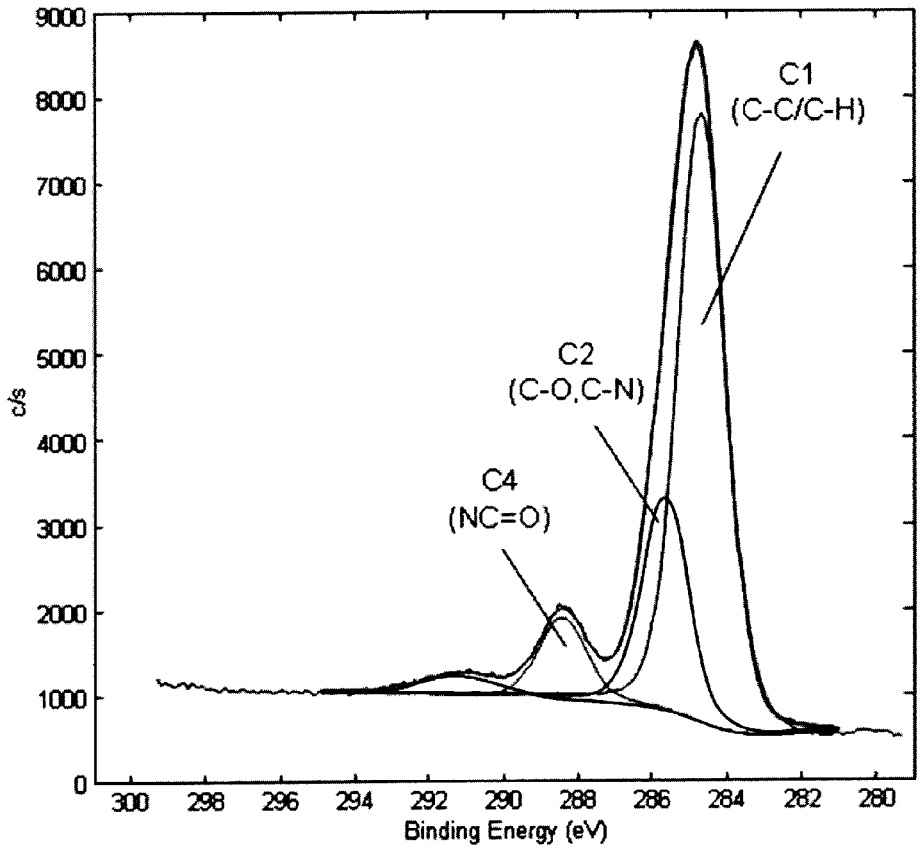
FIG. 3 is a graph showing waveform separation of the spectrum of C1s obtained by XPS analysis of the surface of the enamel layer of the insulated wire described in a comparative example.

FIG. 2 and FIG. 3 present graphs of the observed results. These diagrams are the results obtained by observing the energy state of the 1s orbit of carbon. FIG. 2 represents a graph obtained by subjecting a polyamide-imide resin to a plasma treatment as a surface treatment (Example), and FIG. 3 presents a graph obtained by not performing a surface treatment (Comparative Example). From FIG. 2, it can be seen that the peak at 287.8 eV and the peak at 289.0 eV appeared at the surface of the enamel layer of the insulated wire (Example). From FIG. 3, it can be seen that the peak at 287.8 eV and the peak at 289.0 eV did not appear at the surface of the enamel layer of the insulated wire (Comparative Example).

[Crystallinity]

Sampling was carried out by peeling only 10 mg of the extrusion-coated resin, and the quotient obtained by dividing the difference between the crystallization heat capacity (ΔHc) appearing at the cold crystallization temperature (Tc) and the melting heat capacity (ΔHm) appearing at the melting temperature (Tm) in a DSC analysis, by the melting heat capacity, was used as an index of crystallinity.

$$\text{Crystallinity}=(\Delta Hm-\Delta Hc)/\Delta Hm$$

[Dielectric Breakdown Voltage]

An insulated wire having a length of 50 cm was straightened, and the wire was wrapped with an aluminum foil having a length of 10 mm. An alternating current voltage with a sine wave at a frequency of 50 Hz was applied at a rate of voltage increase of 500 V/sec, and while the voltage was continuously increased, the dielectric breakdown voltage (effective value) was measured. The measurement temperature was 25° C. A dielectric breakdown voltage of 15 kV or higher was considered to be acceptable.

(Arrow Pair Method)

Two rectangular-shaped insulated wires were combined at bend R=10 mm and a contact length of flat area of 10 cm, and were fixed with clips. An alternating current voltage with a sine wave at a frequency of 50 Hz was applied between the respective conductors, and while the voltage was continuously increased, the dielectric breakdown voltage (effective value) was measured. The measurement temperature was 25° C.

[Partial Discharge Initiation Voltage]

Specimens were prepared by combining two insulated wires of each of the Example and Comparative Example into a twisted form in the case of circular-shaped wires, and combining two insulated wires according to the Arrow Pair method in the case of rectangular-shaped wires. An alternating current voltage with a sine wave at a frequency of 50 Hz was applied between the respective conductors, and while the voltage was continuously increased, the voltage (effective value) at which the amount of discharged charge was 10 pC was measured. The measurement temperature was room temperature. For the measurement of the partial discharge-occurring voltage (partial discharge initiation voltage), a partial discharge tester (KPD2050 (trade name) manufactured by Kikusui Electronics Corp.) was used. In the case of circular wires, a specimen having a partial discharge initiation voltage of 1000 Vp or higher was considered acceptable, and a specimen having a partial discharge initiation voltage of less than 1000 Vp was considered as failure. In the case of rectangular-shaped wires, a specimen having a partial discharge initiation voltage of 1400 Vp or higher was considered acceptable, and a specimen having a partial discharge initiation voltage of less than 1400 Vp was considered as failure.

[Adhesiveness]

A notch having a slit width of 1 mm was introduced to the surface of the extrusion-coated resin layer, and a visual inspection was carried out to check whether peeling would occur in the extrusion-coated layer and the enamel layer. A sample which did not have peeling was considered acceptable, and an acceptable sample is rated as A in Tables 1 to 4, while a failure is rated as B in Tables 1 to 4.

[Solvent Resistance]

An insulated wire having a length of 50 cm was wound around a rod having a diameter of 50 mm, and the rod with the wire was immersed in cresol for one hour at room temperature. Thereafter, the rod was taken out, and the surface of the insulated wire was observed. Based on the appearance, a sample without cracks was considered acceptable, and an acceptable sample is rated as A in Tables 1 to 4, while a failure is rated as B in Tables 1 to 4.

The evaluation results of the insulated wires obtained in Examples 1 to 11 and Comparative Examples 1 to 4 are presented in Tables 1 to 4.

In Comparative Examples 1 to 4, despite that an adhesive intermediate layer is provided, the dielectric breakdown voltage or the partial discharge initiation voltage is low, or adhesiveness or solvent resistance is unacceptable. On the contrary, in Examples 1 to 11 are excellent in all of solvent resistance, partial discharge initiation voltage and adhesiveness. Further, dielectric breakdown voltage was sufficiently high in Examples 1 to 11.

TABLE 1

| | Example 1 | Example 2 | Example 3 | Example 4 |
|---|---|---|---|---|
| Conductor shape | Circular | Rectangular | Rectangular | Rectangular |
| Enamel layer | PAI | PAI | PAI + PI | PAI + PI |
| Adhesive intermediate layer | None | None | None | None |
| Extrusion-coated resin layer | PPS | PPS | PPS | PPS |
| Thickness of enamel layer (μm) | 20 | 34 | 30 | 30 |
| Thickness of adhesive intermediate layer (μm) | None | None | None | None |
| Thickness of Extrusion-coated resin layer (μm) | 75 | 102 | 105 | 105 |
| Total thickness | 95 | 136 | 135 | 135 |
| Surface treatment | Plasma treatment | Plasma treatment | Plasma treatment | Corona treatment |
| Functional group containing oxygen | A | A | A | A |
| Dielectric breakdown voltage (kV) | 15.5 | 22.2 | 22.5 | 21.4 |
| Crystallinity (ΔHm − ΔHc)/ΔHm | 0.75 | 0.70 | 0.70 | 0.62 |
| Partial discharge initiation voltage (Vp) | 750.00 | 1500.00 | 1480.00 | 1480.00 |
| Adhesiveness | A | A | A | A |
| Solvent resistant | A | A | A | A |

TABLE 2

| | Example 5 | Example 6 | Example 7 | Example 8 |
|---|---|---|---|---|
| Conductor shape | Rectangular | Rectangular | Rectangular | Rectangular |
| Enamel layer | PAI | PAI + PI | PAI | PAI + PI |
| Adhesive intermediate layer | None | None | None | None |
| Extrusion-coated resin layer | PET | TPI | PPS | PPS |
| Thickness of enamel layer (μm) | 34 | 30 | 34 | 30 |
| Thickness of adhesive intermediate layer (μm) | None | None | None | None |
| Thickness of Extrusion-coated resin layer (μm) | 103 | 105 | 100 | 105 |
| Total thickness | 137 | 135 | 134 | 135 |
| Surface treatment | Plasma treatment | Plasma treatment | Plasma treatment | Plasma treatment |
| Functional group containing oxygen | A | A | A | A |
| Dielectric breakdown voltage (kV) | 24.2 | 22.4 | 22.2 | 22.5 |
| Crystallinity (ΔHm − ΔHc)/ΔHm | 0.51 | None | 1.00 | 0.72 |
| Partial discharge initiation voltage (Vp) | 1450 | 1460 | 1460 | 1480 |
| Adhesiveness | A | A | A | A |
| Solvent resistant | A | A | A | A |

TABLE 3

| | Example 9 | Example 10 | Example 11 |
|---|---|---|---|
| Conductor shape | Rectangular | Rectangular | Rectangular |
| Enamel layer | PAI | PAI + PI | PAI + PI |
| Adhesive intermediate layer | None | None | None |
| Extrusion-coated resin layer | PPS | PPS | PPS |
| Thickness of enamel layer (μm) | 34 | 32 | 34 |
| Thickness of adhesive intermediate layer (μm) | None | None | None |
| Thickness of Extrusion-coated resin layer (μm) | 100 | 105 | 100 |
| Total thickness | 134 | 137 | 134 |
| Surface treatment | Acrylic resin coating | Epoxy resin coating | UV treatment |

TABLE 3-continued

| | Example 9 | Example 10 | Example 11 |
|---|---|---|---|
| Functional group containing oxygen | A | A | A |
| Dielectric breakdown voltage (kV) | 22.5 | 21.5 | 22.2 |
| Crystallinity (ΔHm − ΔHc)/ΔHm | 0.75 | 0.68 | 1.00 |
| Partial discharge initiation voltage (Vp) | 1460 | 1470 | 1460 |
| Adhesiveness | A | A | A |
| Solvent resistant | A | A | A |

TABLE 4

| | Comparative example 1 | Comparative example 2 | Comparative example 3 | Comparative example 4 |
|---|---|---|---|---|
| Conductor shape | Circular | Rectangular | Circular | Rectangular |
| Enamel layer | PAI | PAI | PAI | PAI |
| Adhesive intermediate layer | PPSU | PPSU | PPSU | PPSU |
| Extrusion-coated resin layer | PPS | PPS | PPS | PPS |
| Thickness of enamel layer (μm) | 20 | 34 | 20 | 34 |
| Thickness of adhesive intermediate layer (μm) | 3 | 3 | 3 | 3 |
| Thickness of Extrusion-coated resin layer (μm) | 77 | 100 | 77 | 100 |
| Total thickness | 100 | 137 | 100 | 137 |
| Surface treatment | None | None | None | None |

TABLE 4-continued

| | Comparative example 1 | Comparative example 2 | Comparative example 3 | Comparative example 4 |
|---|---|---|---|---|
| Functional group containing oxygen | Indeterminable | Indeterminable | Indeterminable | Indeterminable |
| Dielectric breakdown voltage (kV) | 14.8 | 22.0 | 14.8 | 22.0 |
| Crystallinity (ΔHm − ΔHc)/ΔHm | 0.65 | 0.70 | 1.00 | 0.40 |
| Partial discharge initiation voltage (Vp) | 1048 | 1460 | 1050 | 1480 |
| Adhesiveness | A | A | B | A |
| Solvent resistant | B | B | A | B |

Having described our invention as related to the present embodiments, it is our intention that the invention not be limited by any of the details of the description, unless otherwise specified, but rather be construed broadly within its spirit and scope as set out in the accompanying claims.

This application claims priority on Patent Application No. 2011-176496 filed in Japan on Aug. 12, 2011, which is entirely herein incorporated by reference.

What is claimed is:

1. An insulated wire comprising:

a conductor, a baked enamel layer containing at least a polyamide-imide provided on the outer periphery of the conductor directly or through an insulated layer, and at least one extrusion-coated resin layer provided on the outer side of the baked enamel layer, wherein the baked enamel layer has at least one functional group selected from the group consisting of a carboxyl group, an ester group, an ether group and a hydroxyl group on the outer surface thereof, and adheres to the extrusion-coated resin layer.

2. The insulated wire according to claim 1, wherein the functional group is introduced into the outer surface of the baked enamel layer by plasma-treatment of the baked enamel layer.

3. The insulated wire according to claim 1, wherein cross-section shape of the conductor is rectangular.

4. The insulated wire according to claim 1, wherein the extrusion-coated resin layer is composed of polyphenylene sulfide.

5. The insulated wire according to claim 4, wherein the crystallization heat capacity (ΔHc) appearing at the crystallization temperature (Tc) and the melting heat capacity (ΔHm) appearing at the melting point (Tm) in a DSC analysis of the polyphenylene sulfide meet the following formula:

$$0.5 \leq (\Delta Hm - \Delta Hc)/\Delta Hm \leq 1.0.$$

* * * * *